US006464270B1

(12) United States Patent
Sloan et al.

(10) Patent No.: US 6,464,270 B1
(45) Date of Patent: Oct. 15, 2002

(54) EXTERIOR HANDLE ASSEMBLY FOR MOTOR VEHICLE DOOR

(75) Inventors: John Leonard Sloan, Clarkston; Paul Martin Dedrich, Grand Blanc; Derrick V. Grahn, Birmingham, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/862,842

(22) Filed: May 23, 2001

(51) Int. Cl.[7] ..... E05B 3/00

(52) U.S. Cl. ..... 292/336.3; 292/DIG. 22; 292/DIG. 65

(58) Field of Search ..... 292/347, DIG. 22, 292/DIG. 65, 348, DIG. 12, DIG. 8, 336.3

(56) References Cited

U.S. PATENT DOCUMENTS

| | | | | | |
|---|---|---|---|---|---|
| 3,799,596 | A | * | 3/1974 | Nozomu et al. | 180/286 |
| 3,819,228 | A | * | 6/1974 | Cornacchia | 292/DIG. 65 |
| 3,858,921 | A | * | 1/1975 | Kuki | 292/210 |
| 3,967,844 | A | * | 7/1976 | Torii et al. | 292/210 |
| 4,536,021 | A | * | 8/1985 | Mochida | 292/201 |
| 4,988,134 | A | | 1/1991 | Vidwans et al. | 292/198 |
| 5,267,769 | A | * | 12/1993 | Bonne et al. | 292/201 |
| 5,431,462 | A | * | 7/1995 | Lignell | 292/216 |
| 5,560,659 | A | * | 10/1996 | Dault | 292/336.3 |
| 5,669,642 | A | * | 9/1997 | Kang | 292/336.3 |
| 5,676,002 | A | * | 10/1997 | Hoeptner, III | 292/346 |
| 5,725,262 | A | * | 3/1998 | Kritzler | 292/336.3 |
| 5,743,575 | A | * | 4/1998 | McFarland | 16/82 |
| 5,865,481 | A | * | 2/1999 | Buschmann | 292/169.11 |
| 6,007,122 | A | | 12/1999 | Linder et al. | 292/336.3 |
| 6,010,167 | A | * | 1/2000 | Tanimoto et al. | 292/336.3 |
| 6,042,159 | A | * | 3/2000 | Spitzley et al. | 16/111.1 |
| RE36,694 | E | * | 5/2000 | McFarland | 16/DIG. 6 |
| 6,070,923 | A | * | 6/2000 | Tanimoto et al. | 292/336.3 |
| 6,073,980 | A | * | 6/2000 | Arabia et al. | 292/216 |
| 6,099,052 | A | * | 8/2000 | Spitzley | 292/336.3 |
| 6,141,914 | A | * | 11/2000 | Feige et al. | 292/DIG. 31 |
| 6,173,535 | B1 | * | 1/2001 | Deischl et al. | 292/DIG. 31 |
| 6,240,754 | B1 | * | 6/2001 | Petersen | 292/346 |
| 6,241,294 | B1 | * | 6/2001 | Young et al. | 292/251.5 |

* cited by examiner

*Primary Examiner*—Robert J. Sandy
*Assistant Examiner*—Matthew E. Rodgers
(74) *Attorney, Agent, or Firm*—Laura C. Hargitt

(57) ABSTRACT

An exterior handle assembly for a motor vehicle door including an escutcheon, a handle including a horizontal hand grip and a pair of vertical arms supported on the escutcheon for pivotal movement about a horizontal first axis, and a multiplier lever supported on the escutcheon for pivotal movement about a horizontal second axis. The multiplier lever surrounds one of the vertical arms of the handle for concurrent pivotal movement therewith and is linked by a push rod to a release lever of a door lock such that pivotal movement of the handle to an extended position of the hand grip releases a fork bolt to release the door. The separation between the horizontal first and second axes amplifies the pivotal movement of the multiplier lever. The exterior handle assembly further includes a blocking lever supported on the escutcheon for pivotal movement from an inactive position remote from the multiplier lever to an active position facing a shoulder on the multiplier lever and a spring biasing the blocking lever to its inactive position. The blocking lever has less inertia than the handle and pivots from its inactive position to its active position at the onset of a side impact on the vehicle body to immobilize the multiplier lever and the handle before the hand grip attains its extended position.

5 Claims, 2 Drawing Sheets

EXTERIOR HANDLE ASSEMBLY FOR MOTOR VEHICLE DOOR

TECHNICAL FIELD

This invention relates to an exterior handle assembly for a motor vehicle door.

BACKGROUND OF THE INVENTION

A motor vehicle door typically includes a lock for securing the door closed and an exterior handle assembly linked to the lock for releasing the door from outside of the vehicle. The door lock usually includes a fork bolt which cooperates with a striker on the vehicle to secure the door closed and which releases the striker in response to pivotal movement of a release lever of the door lock. The exterior handle assembly commonly includes a handle pivotally supported on the door and linked to the door lock release lever by a push rod. When the handle is manually pivoted from a retracted position to an extended position, the push rod pivots the release lever to release the fork bolt so the door can be opened.

It has been known to mount a blocking lever of lesser inertia on the exterior handle which normally assumes an inactive position not interfering with pivotal movement the handle. At the onset of a side impact, however, the blocking lever pivots rapidly to an active position immobilizing the handle before the handle attains its extended position. In some applications, the blocking lever is a pendulum on the handle which is maintained by gravity in its inactive position. In other applications, a spring on the handle maintains the blocking lever in its inactive position.

SUMMARY OF THE INVENTION

This invention is an exterior handle assembly for a motor vehicle door including an escutcheon on a door outer panel, a handle including a horizontal hand grip and a pair of vertical arms supported on the escutcheon for pivotal movement about a horizontal first axis, and a multiplier lever supported on the escutcheon for pivotal movement about a horizontal second axis parallel to the first axis. The multiplier lever surrounds one of the vertical arms of the handle for concurrent pivotal movement therewith and is linked by a push rod to a release lever of a door lock on the door such that pivotal movement of the handle from a retracted position of the hand grip to an extended position of the hand grip releases a fork bolt in the door lock to release the door. The separation between the horizontal first and second axes amplifies the pivotal movement of the multiplier lever relative to the pivotal movement of the handle to minimize the angular interval between the retracted and extended positions of the hand grip. The exterior handle assembly further includes a blocking lever supported on the escutcheon for pivotal movement from an inactive position remote from the multiplier lever to an active position facing a shoulder on the multiplier lever and a spring biasing the blocking lever to its inactive position. The blocking lever has less inertia than the handle and pivots from its inactive position to its active position at the onset of a side impact on the vehicle body thereby immobilizing the multiplier and the handle before the hand grip attains its extended position.

DESCRIPTION OF THE PREFERRED EMBODIMENT

Figure 1:
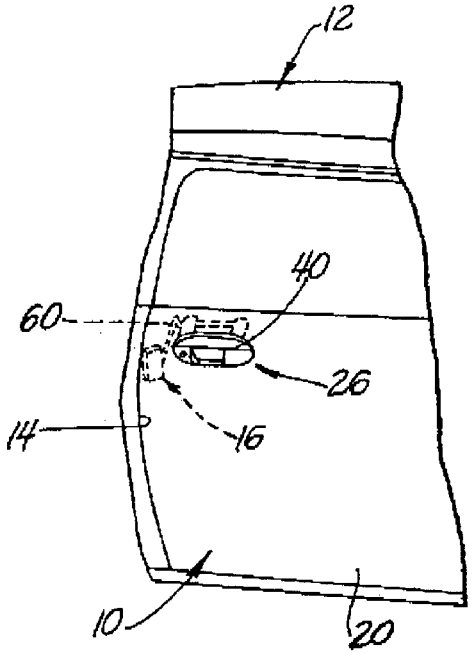
FIG. 1 is a perspective view of a motor vehicle door having thereon an exterior handle assembly according to this invention.
Figure 2:
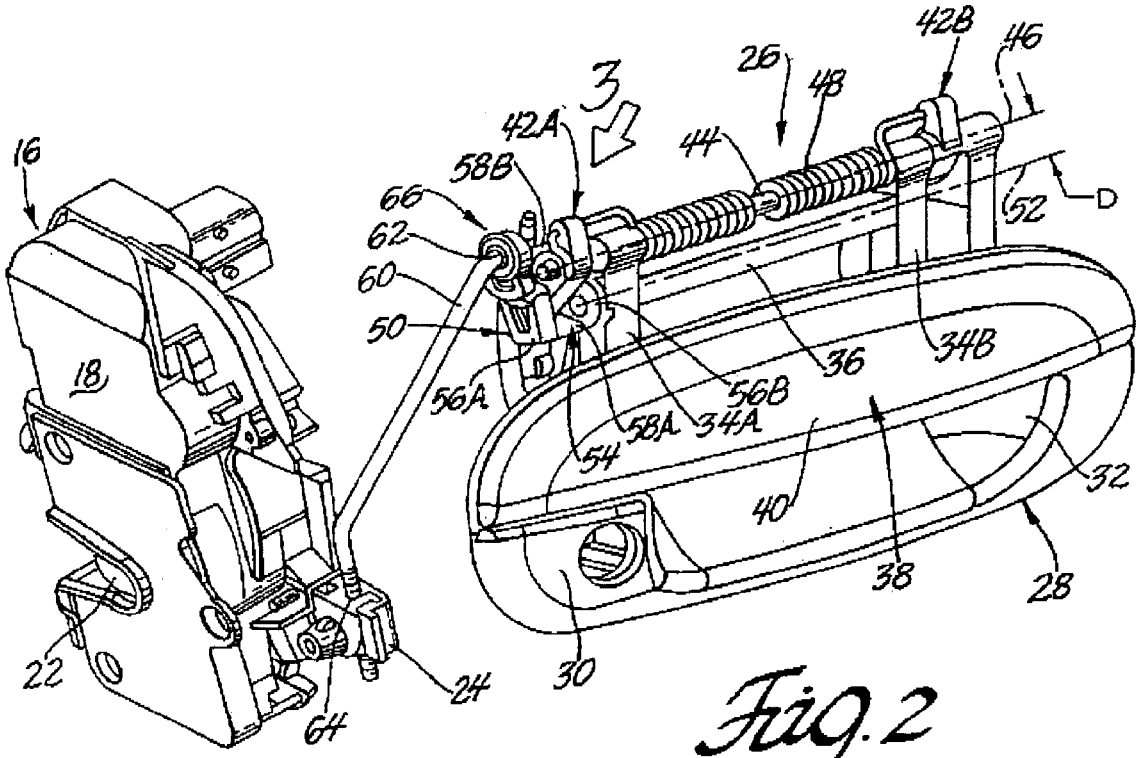
FIG. 2 is a perspective view of the exterior handle assembly according to this invention.

Referring to FIGS. 1–2, a motor vehicle door 10 is supported on a body 12 of the vehicle for pivotal movement between a closed position, FIG. 1, closing a door opening 14 in the body and an open position, not shown, exposing the door opening. A door lock 16 includes a housing 18 mounted on the door between an exposed outer panel 20 thereof and an inner panel, not shown, facing the interior of the vehicle body. The door lock includes a fork bolt 22 and a release lever 24 each pivotally supported on the housing 18. The fork bolt has a latched position in which it cooperates with a striker, not shown, on the vehicle body in retaining the door 10 in its closed position. Downward vertical pivotal movement of the release lever 24 releases the fork bolt from its latched position to permit escape of the striker from the fork bolt and pivotal movement of the door from its closed position to its open position.

An exterior handle assembly 26 according to this invention includes an escutcheon 28 rigidly attached to the door outer panel 20 having a key bezel 30, an exposed pocket 32 around the key bezel, and a pair of rigid vertical braces 34A,34B behind the outer panel 20 interconnected by a horizontal brace 36. A handle 38 of the handle assembly includes a horizontal hand grip 40 in the exposed pocket 32 of the escutcheon and a pair of integral vertical arms 42A,42B behind the outer panel 20. Each of the vertical arms 42A,42B has a bore 43 therein, FIG. 3, around a pivot shaft 44 on the vertical braces 34A,34B. The bores and the pivot shaft constitute bearing means through which the vertical arms are supported on the escutcheon for pivotal movement about a horizontal first axis 46 of the handle assembly between a retracted position, FIGS. 1–2, of the hand grip 40 nested in the pocket 32 and an extended position, not shown, of the hand grip outside of the pocket. A coil torsion spring 48 on the pivot shaft 44 biases the handle toward the retracted position of the hand grip.

Figure 3:
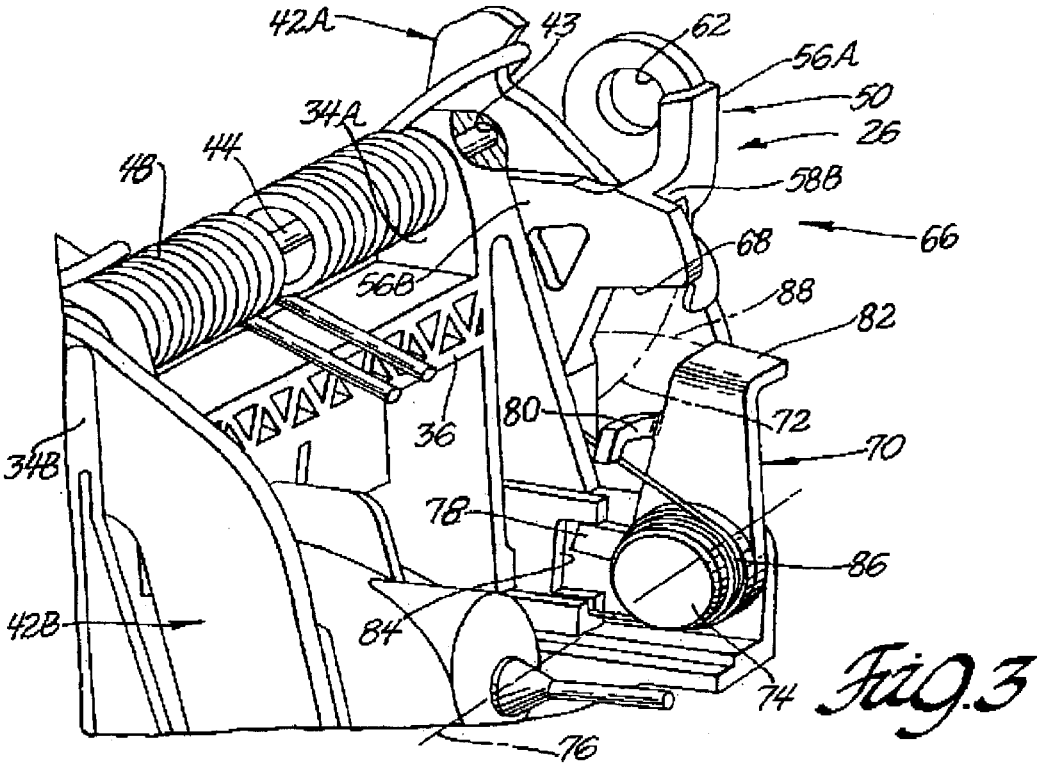
FIG. 3 is a fragmentary perspective view taken generally in the direction of arrow 3 in FIG. 2.
Figure 4:
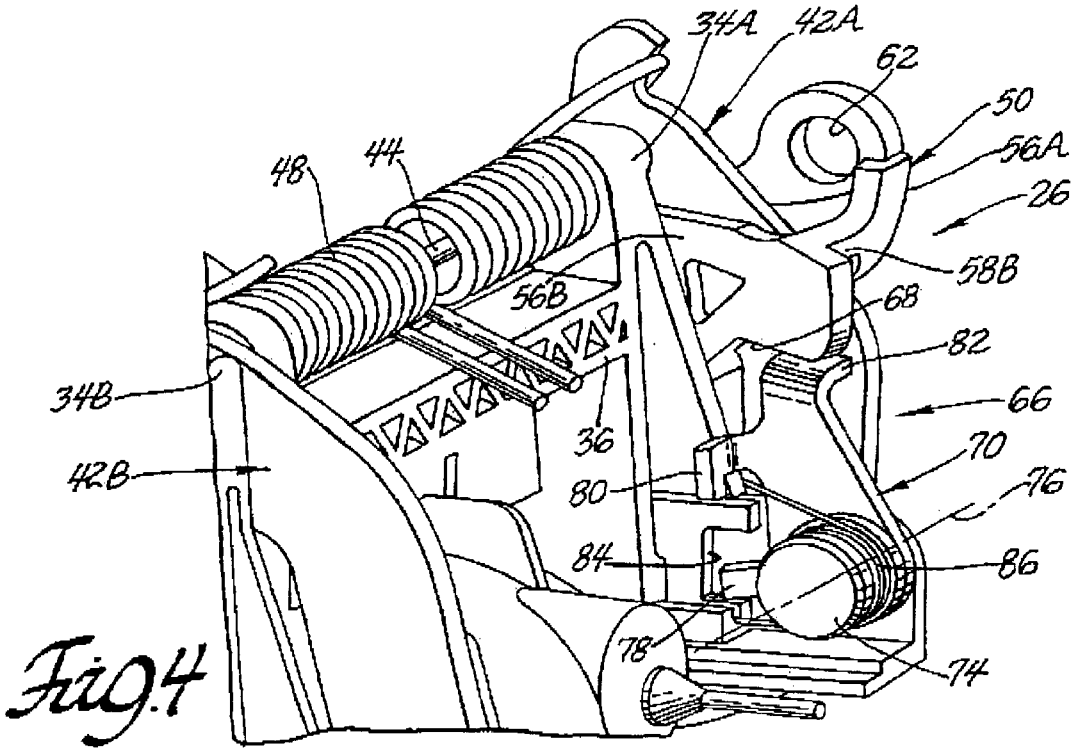
FIG. 4 s similar to FIG. 3 showing structural elements of the exterior handle assembly according to this invention in different relative positions.

As seen best in FIGS. 2–4, a multiplier lever 50 of the exterior handle assembly is supported on the vertical brace 34A of the escutcheon 28 for pivotal movement about a horizontal second axis 52 parallel to the first axis 46 and separated therefrom by a span dimension "D", FIG. 2. The vertical arm 42A of the handle extends through a window 54 in the multiplier lever defined by a pair sides 56A,56B of the multiplier lever on opposite sides of the vertical arm and a pair of ends 58A,58B of the multiplier lever facing corresponding edges of the vertical arm.

An upper end of a push rod 60 is received in a socket 62 at the top of the side 56A of the multiplier lever. A lower end of the push rod 60 is received in a socket 64 in the release lever 24 of the door lock 16. When the hand grip 40 of the handle 38 is grasped and the handle manually pivoted from the retracted position of the hand grip to the extended position of the hand grip, an edge of the vertical arm 42A seats on the end 58A of the multiplier lever and induces concurrent counterclockwise pivotal movement, FIG. 2, of the multiplier lever about the second axis 52. At the same time, the push rod 60 pivots the release lever 24 downward to release the fork bolt 22 from its latched position. Because of the span dimension "D" between the first and second axes 46,52, pivotal movement of the multiplier lever is amplified relative to the pivotal movement of the handle to minimize the angular interval between the retracted and extended positions of the hand grip 40.

As seen best in FIGS. 3–4, a blocking apparatus 66 of the exterior handle assembly 26 includes a horizontal shoulder 68 on the side 56B of the multiplier lever and a blocking lever 70. The horizontal shoulder 68 traverses an arc 72, FIG. 3, during pivotal movement of the multiplier lever corresponding to pivotal movement of the handle 38 from the retracted position of the hand grip to the extended position of the hand grip. The blocking lever 70 is supported on a rivet 74 on the escutcheon 28 for pivotal movement about a horizontal third axis 76 and includes a lower tang 78, an upper tang 80, and a flange 82 bent perpendicular to the plane of the blocking lever.

The lower tang 76 is disposed in a notch 84 in the escutcheon and cooperates therewith in limiting clockwise pivotal movement of the blocking lever to an inactive position, FIG. 3, and counterclockwise pivotal movement of the blocking lever to an active position, FIG. 4. A hairpin spring 86 around the rivet 74 bears against the escutcheon and the upper tang 80 and biases the blocking lever to its inactive position. The flange 82 on the blocking lever traverses an arc 88, FIG. 3, during pivotal movement of the blocking lever which intersects the arc 72 traversed by the horizontal shoulder 68 on the multiplier lever. The spring 86 normally maintains the blocking lever 70 in its inactive position in which the flange 82 thereon is remote from the arc 72 traversed by the horizontal shoulder on the multiplier lever. Accordingly, the blocking lever normally does not interfere with pivotal movement of the multiplier lever corresponding to concurrent pivotal movement of the handle 38 to release the fork bolt 22 and the door 10.

The blocking lever 70 is smaller and lighter than the handle 38 and, therefore, has less inertia than the handle. Thus, at the onset of rapid lateral acceleration of the vehicle body 12 attributable, for example, to a side impact thereon, the blocking lever 70 pivots against the light bias of the spring 86 from its inactive position to its active position substantially more rapidly than the handle pivots from the retracted position of the hand grip to the extended position of the hand grip. In the active position of the blocking lever, the flange 82 thereon obstructs the arc 72 traversed by the horizontal shoulder 68 at a location short of the position of the multiplier lever corresponding to release of the fork bolt 22. Accordingly, the flange 82 on the blocking lever engages the horizontal shoulder 68 and immobilizes each of the multiplier lever and the handle before the fork bolt is released. While the multiplier lever 50 is also smaller and has less inertia than the handle 38, it is positively prevented from inertially unlatching the fork bolt 22 independently of the handle because of interference between the end 58B of the multiplier lever constituting an edge of the window 54 therein and the corresponding edge of the vertical arm 42A of the handle.

While only a preferred embodiment of this invention has been described herein, it will be appreciated that other forms could be readily adapted by one skilled in the art. Accordingly, the scope of this invention is to be considered limited only by the following claims.

The embodiments of the invention in which an exclusive property or privilege is claimed are defined as follows:

1. On a motor vehicle door having a lock including a fork bolt retained in a latched position securing the door in a closed position and a release lever pivotable on a housing of the lock to a position releasing the fork bolt from its latched position, an exterior handle assembly comprising:

an escutcheon supported on an outer panel of the door, a handle including a hand grip and a pair of vertical arms, a support means operable to support each of the pair of vertical arms on the escutcheon for outward pivotal movement about a horizontal first axis from a retracted position of the manual grip to an extended position of the manual grip, a multiplier lever supported on the escutcheon for pivotal movement about a second axis parallel to and separated from the first axis in response to pivotal movement of the handle from the retracted position of the manual grip to the extended position of the manual grip, the multiplier lever being linked to the release lever of the lock and pivoting the release lever to the position thereof releasing the fork bolt from its latched position when the handle attains the extended position of the hand grip and the separation between the first and second axes amplifying the angle of pivotal movement of the multiplier lever relative to the angle of pivotal movement of the handle thereby to minimize the angular interval between the retracted and extended positions of the hand grip, a restraint means operable to prevent the multiplier lever from pivoting toward the position thereof corresponding to release of the fork bolt from its latched position independently of the handle, and a blocking lever supported on the escutcheon for pivotal movement from an inactive position remote from the multiplier lever to an active position obstructing pivotal movement of the multiplier lever in a position of the multiplier lever short of the position thereof corresponding to release the fork bolt from its latched position, the blocking lever having less inertia than the handle and pivoting in response to a side impact on the door to its active position ahead of the multiplier lever thereby to immobilize the handle short of the position thereof corresponding to release the fork bolt from its latched position.

2. The exterior door handle assembly recited in claim 1 further comprising:

a spring means operable to resiliently maintain the blocking lever in its inactive position.

3. The exterior door handle assembly recited in claim 2 wherein the restraint means comprises:

a window in the multiplier lever surrounding one of the vertical arms of the handle including a first end facing a first edge of the one vertical arm and cooperating therewith in effecting concurrent pivotal movement of the multiplier lever with the handle toward the position of the multiplier lever corresponding to release of the fork bolt from its latched position and a second edge facing an opposite second edge of the one vertical arm and cooperating therewith in preventing pivotal movement of the multiplier lever independent of the handle to the position of the multiplier lever corresponding to release of the fork bolt from its latched position.

4. The exterior door handle assembly recited in claim 3 wherein the support means comprises:

a pivot shaft supported on the escutcheon behind the door outer panel, a bearing means operable to pivotally support each of the vertical arms of the handle on the pivot shaft, and a torsion spring around the pivot shaft biasing each of the vertical arms of the handle toward the retracted position of the hand grip.

5. The exterior door handle assembly recited in claim 4 wherein the spring means comprises:

a hairpin spring coiled around the axis of rotation of the blocking lever and bearing at opposite ends against respective ones of the escutcheon and the blocking lever.

* * * * *